US006899986B2

(12) United States Patent
Aoki et al.

(10) Patent No.: US 6,899,986 B2
(45) Date of Patent: May 31, 2005

(54) IMAGE FORMING METHOD AND TONER FOR USE IN THE METHOD

(75) Inventors: Mitsuo Aoki, Numazu (JP); Kumi Hasegawa, Numazu (JP); Toshiaki Higaya, Kawasaki (JP); Yasushi Koichi, Yamato (JP); Yutaka Takahashi, Yokohama (JP); Tadashi Kasai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 221 days.

(21) Appl. No.: 10/252,070

(22) Filed: Sep. 23, 2002

(65) Prior Publication Data

US 2003/0186155 A1 Oct. 2, 2003

(30) Foreign Application Priority Data

Sep. 21, 2001 (JP) ..... 2001-288497
Sep. 21, 2001 (JP) ..... 2001-288510

(51) Int. Cl.[7] ..... G03G 13/20
(52) U.S. Cl. ..... 430/124; 430/109.4; 430/111.4
(58) Field of Search ..... 430/124, 99, 109.4, 430/111.4; 399/330, 331

(56) References Cited

U.S. PATENT DOCUMENTS

| | | | | |
|---|---|---|---|---|
| 5,832,354 | A | 11/1998 | Kouno et al. | |
| 5,912,100 | A | 6/1999 | Aoki et al. | |
| 5,915,147 | A | 6/1999 | Kouno et al. | |
| 5,994,016 | A | 11/1999 | Kuramoto et al. | |
| 6,002,903 | A | 12/1999 | Hayase et al. | |
| 6,060,201 | A | 5/2000 | Kinoshita et al. | |
| 6,120,960 | A | 9/2000 | Aoki et al. | |
| 6,169,871 | B1 | 1/2001 | Higaya | |
| 6,221,549 | B1 | 4/2001 | Emoto et al. | |
| 6,248,488 | B1 | 6/2001 | Kinoshita et al. | |
| 6,255,028 | B1 | 7/2001 | Hasegawa et al. | |
| 6,255,632 | B1 | 7/2001 | Yokoyama et al. | |
| 6,262,404 | B1 | 7/2001 | Higaya et al. | |
| 6,292,648 | B1 | 9/2001 | Higaya et al. | |
| 6,294,302 | B1 * | 9/2001 | Serizawa et al. | 430/111.4 |
| 6,303,257 | B1 | 10/2001 | Hasegawa et al. | |
| 6,327,456 | B1 | 12/2001 | Higaya | |
| 6,340,810 | B2 | 1/2002 | Yokoyama et al. | |
| 6,403,275 | B1 | 6/2002 | Kuramoto et al. | |
| 6,432,590 | B1 | 8/2002 | Ueda et al. | |
| 2001/0006583 | A1 | 7/2001 | Tomita | |

* cited by examiner

*Primary Examiner*—Janis L. Dote
(74) *Attorney, Agent, or Firm*—Oblon, Spivak, McClelland, Maier & Neustadt, P.C.

(57) ABSTRACT

An image forming method, comprising passing a toner image-bearing sheet through a nip defined between two rollers including a heater roller to fix the toner image on the sheet, wherein the toner image is formed from a toner comprising a binder resin, and a colorant, wherein the toner image before the passage through the nip has a toner volume V1 and a toner image area S1, wherein the toner image after the passage through the nip has a toner volume V2 and a toner image area S2, and wherein a volume change Vt and an area change St defined by the formulas shown below are 30% or less and 20% or less, respectively:

$$Vt(\%)=(V1-V2)/V1\times 100$$

$$St(\%)=(S2-S2)/S1\times 100.$$

Alternatively, the toner image before the passage through the nip has a surface roughness of 2.5 $\mu$m or less.

22 Claims, 3 Drawing Sheets

IMAGE FORMING METHOD AND TONER FOR USE IN THE METHOD

BACKGROUND OF THE INVENTION

1. Field of the Invention

This invention relates to an image forming method in which toner images are formed by developing an electrostatic latent image by, for example, electrophotography, electrostatic recording or electrostatic printing, and to a toner useful for the image forming method.

2. Discussion of the Prior Art

Various electrophotographic image forming methods have been disclosed in U.S. Pat. No. 2,297,691, Japanese Patent Publications Nos. 42-23910 and 43-24748. The methods typically include the following processes: (a) a surface of a photoconductor is charged (charging process); (b) the charged surface is exposed to light to form an electrostatic latent image thereon (latent image forming process); (c) the latent image is developed with a toner to form a toner image on the photoconductor (developing process); (d) the toner image is transferred directly or indirectly through an intermediate transfer member onto a transfer sheet such as paper (transferring process); and (e) the toner image is fixed to the sheet by application of heat, pressure, solvent vapors, or combination thereof (fixing process).

As the method for developing electrostatic latent images, there are known a wet developing process using a liquid developer containing a pigment or a dye dispersed in an insulating organic liquid medium; and a dry developing process, such as a magnetic brush method (U.S. Pat. No. 2,874,063), a cascade method (U.S. Pat. No. 2,618,552), a powder cloud method (U.S. Pat. No. 2,221,776) and a method using a conductive magnetic toner (U.S. Pat. No. 3,909,258). A toner for use in the dry developing process generally includes a colorant, such as a pigment or a dye, and a binder resin. A magnetic particle such as magnetite is incorporated in the toner for forming a magnetic toner. The toner may be used by itself as a single component developer or may be used in conjunction with a carrier, such as glass beads or iron powder, as a two-component developer.

Toner image fixing methods are broadly classified into two methods, i.e., a contact fixing method and a non-contact fixing method. Typical contact fixing methods include a heating roller fixing method and a heating belt fixing method. Typical non-contact fixing methods include a flash fixing method and an oven fixing method in which a toner image is fixed in a heated atmosphere). Above all, the heating roller fixing method in which a toner image is brought into direct contact with a heating roller is widely used because of its high thermal efficiency and of compactness of the device.

The heating roller fixing method, however, has problems because a large thermal energy is absorbed by the transfer sheet such as paper during the contact of the image-bearing sheet with the heating roller. Thus, when the preset temperature of the heating roller is low, the temperature of the surface of the heating roller is apt to decrease to bring about insufficient fixation of the toner image on the sheet. Such insufficient fixation will not occur when the preset temperature of the heating roller is high. In this case, however, the toner melted upon contact with the heating roller has so low a viscosity that the reproducibility of the fixed toner image is lowered especially in fine line portions thereof. Various toners have been proposed for use in an image forming method utilizing a heating roller fixing method. Japanese Patent No. 2743476 discloses a toner including a polyester resin, and a polar group-containing wax, wherein the melt viscosities of the polyester resin and wax are specifically controlled. Japanese Laid Open Patent Publications No. H03-122661 and No. H04-85550 and Japanese Examined Patent Publication No. H08-16804 disclose a toner including a polyester resin having a specific melt viscosity, and a releasing agent having a specific melt viscosity, wherein the temperature dependency of the melt viscosity of the polyester resin in a temperature range of 80 to 120° C. is specifically controlled. Japanese Laid Open Patent Publication No. H08-12459 discloses an encapsulated toner for fixation to a film including a polyester resin having a specific melt viscosity in a temperature range of 80 to 120° C., and a releasing agent, wherein the temperature dependency of the melt viscosity of the polyester resin is specifically controlled. Japanese Examined Patent Publication No. H07-82250 discloses a toner for fixation to a film including a polyester resin having a specific melt viscosity in a temperature range of 120 to 150° C., an organometallic compound, and a releasing agent, wherein the temperature dependency of the melt viscosity of the polyester resin is specifically controlled. Japanese Examined Patent Publication No. H07-72809 discloses a toner containing a styrene-acrylate copolymer resin having specifically controlled temperature dependency of the melt viscosity thereof. Japanese Laid Open Patent Publication No. H10-246989 proposes a toner containing a specific charge controlling agent and having a specific temperature dependency of the average viscosity. Japanese Laid Open Patent Publication No. H08-220793 discloses a toner having a specific voidage, H08-278659 discloses a toner having a specific particle size distribution and a specific voidage and H10-48874 discloses a toner containing a silicone compound and an inorganic powder and having a specific particle size distribution and a specific voidage.

While these toners have an effect in improving fixation efficiency, an improvement of image quality is not fully satisfactory.

Japanese Laid Open Patent Publication No. H06-230602 proposes a magnetic toner which gives a toner image having a specific ratio of the height thereof before fixation to the height thereof after fixation. The problem to be solved by the Japanese publication is to prevent offset and other troubles during duplex copying and is not concerned with improvement of image quality.

With an increasing demand for high quality images in recent years, particle diameter of toner tends to be made smaller and smaller. With the use of a small particle size toner, a suitable pressure is not easily applied thereto so that the fixation efficiency of the toner image is lowered. This tendency is significant when the heating roller fixation is performed at a low pressure. With a fixing device capable of applying a high pressure to a toner image bearing sheet, satisfactory fixation efficiency is obtainable. However, when the toner image-bearing sheet is relatively thick, the toner image is crushed during fixation to cause deterioration of the image quality. In particular, in the case of digital development, reproducibility of independent dots is adversely affected so that half tone portions of the image are not uniform microscopically. Thus, when the image is observed with naked eyes, human observers are likely to have an impression of a roughness.

SUMMARY OF THE INVENTION

It is an object of the present invention to provide an image forming method utilizing a heating roller fixation device and capable of producing high grade toner images at a wide range of the surface temperature of the heating roller.

Another object of the present invention is to provide a toner useful for carrying out the above method.

It is a further object of the present invention to provide an image forming method capable of forming toner images having smooth surface, uniform image density and uniform gloss.

In accomplishing the above object, there is provided in accordance with first aspect of the present invention an image forming method, comprising passing a toner image-bearing sheet through a nip defined between two rollers including a heater roller to fix the toner image on said sheet, wherein said toner image is formed from a toner comprising a binder resin, a wax and a colorant, wherein the toner image before the passage through said nip has a toner volume V1 and a toner image area S1, wherein the toner image after the passage through said nip has a toner volume V2 and a toner image area S2, and wherein a volume change Vt and an area change St defined by the formulas shown below are 30% or less and 20% or less, respectively:

$$Vt(\%)=(V1-V2)/V1\times 100$$

$$St(\%)=(S2-S1)/S1\times 100$$

wherein V1, V2, S1 and S2 are as defined above.

The present invention also provides a toner for use in an image forming method which comprises developing an electrostatic latent image with said toner to form a developed toner image, transferring said developed toner image to a sheet to form a toner image-bearing sheet, and passing said toner image-bearing sheet through a nip defined between two rollers including a heater roller to fix the toner image on said sheet, wherein said toner comprises a binder resin, a wax and a colorant, wherein said toner image on said sheet before the passage through said nip has a toner volume V1 and a toner image area S1, wherein said toner image after the passage through said nip has a toner volume V2 and a toner image area S2, and wherein a volume change Vt and an area change St defined by the formulas shown below are 30% or less and 20% or less, respectively:

$$Vt(\%)=(V1-V2)/V1\times 100$$

$$St(\%)=(S2-S1)/S1\times 100$$

wherein V1, V2, S1 and S2 are as defined above.

The present invention also provides a toner cartridge containing the above toner.

In a second aspect of the present invention there is provided an image forming method, comprising passing a toner image-bearing sheet through a nip defined between two rollers including a heater roller to fix the toner image on said sheet, wherein said toner image is formed from a toner comprising a binder resin, and a colorant, wherein the toner image before the passage through said nip has a surface roughness of 2.5 $\mu$m or less.

BRIEF DESCRIPTION OF THE DRAWINGS

Other objects, features and advantages of the present invention will become apparent from the detailed description of the preferred embodiments of the invention which follows, when considered in the light of the accompanying drawings, in which.

DETAILED DESCRIPTION OF THE PREFERRED EMBODIMENTS OF THE INVENTION

Figure 1:
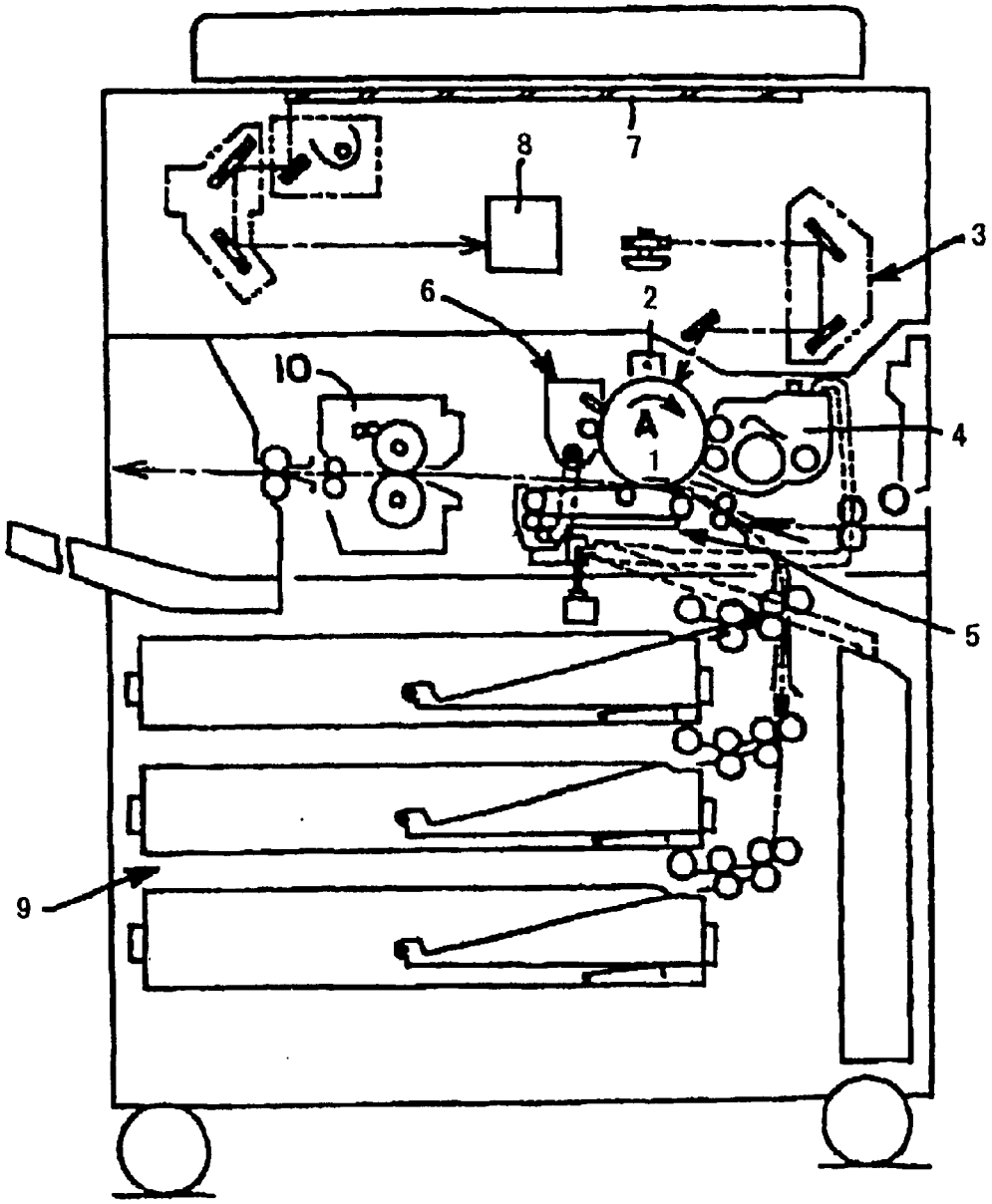
FIG. 1 is a vertical cross-sectional view schematically illustrating an example of an image forming apparatus useful for carrying out the image forming method according to the present invention

Referring to FIG. 1, an image forming apparatus, which may be a digital copying machine, employs a well-known electrographic system and has a drum-shaped photoconductor 1. Around the photoconductor 1, a charger 2, exposure means 3, developing means 4, transfer means 5, and cleaning means 6 for performing electrographic copying process are disposed along the rotating direction of the photoconductor 1 shown by the arrow A. Reading means 8 reads an original image placed on a table 7 disposed on an upper side of the copying machine as an image signal and the exposure means 3 forms an electrostatic latent image on the photoconductor 1 based on the image signal. The electrostatic latent image formed on the photoconductor 1 is developed into a toner image by the developing means 4 and the toner image is electrostatically transferred onto a transfer paper fed from a paper supply unit 9 by the transfer means 5. The transfer paper bearing the toner image is transported to fixing means 10 and discharged after the toner image has been fixed thereon.

Figure 2:
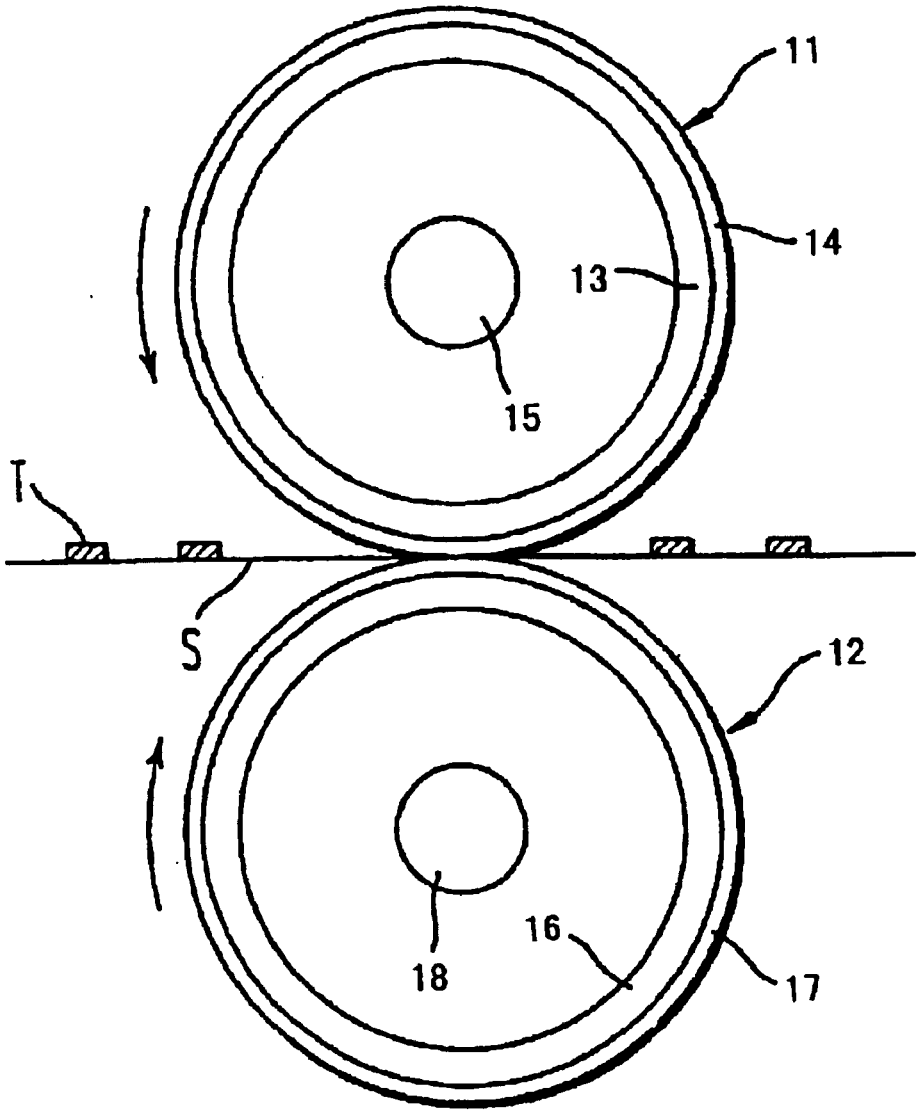
FIG. 2 is a vertical cross-sectional view schematically illustrating one embodiment of a heating roller fixation device for the image forming apparatus of FIG. 1.

A suitable fixing means for use in the present invention is illustrated in FIG. 2. The fixing means shown in FIG. 2 is a heating roller fixing device in which a developed toner image is fixed by passing through a nipped section of two rollers. In FIG. 2, the reference numeral 11 denotes a fixing roller (heating roller), and numeral 12 denotes a pressure roller. The fixing roller 11 includes a metal cylinder 13 made of a heat conductive metal such as aluminum, iron, stainless steel or brass, and an offset preventing layer 14 covering the metal cylinder 13 and made of, for example, a room temperature vulcanizing (RTV) rubber, silicone rubber, a tetrafluoroethylene-perfluoroalkylvinylether copolymer (PFA), or a polytetrafluoroethylene (PTFE). In the metal cylinder 13, a heat lamp 15 is disposed. The pressure roller 12 has a metal cylinder 16 made of the same metal as the metal cylinder 13 of the fixing roller 11, and an offset preventing layer 17 made of PFA, PTFE or the like. In addition, if desired, a heat lamp 18 may be arranged in the pressure roller 12. The fixing roller 11 and the pressure roller 12 are in a pressure engagement with each other by a pressing member such as springs (not shown), so that the two rollers rotate in the direction opposite directions.

Figure 3:
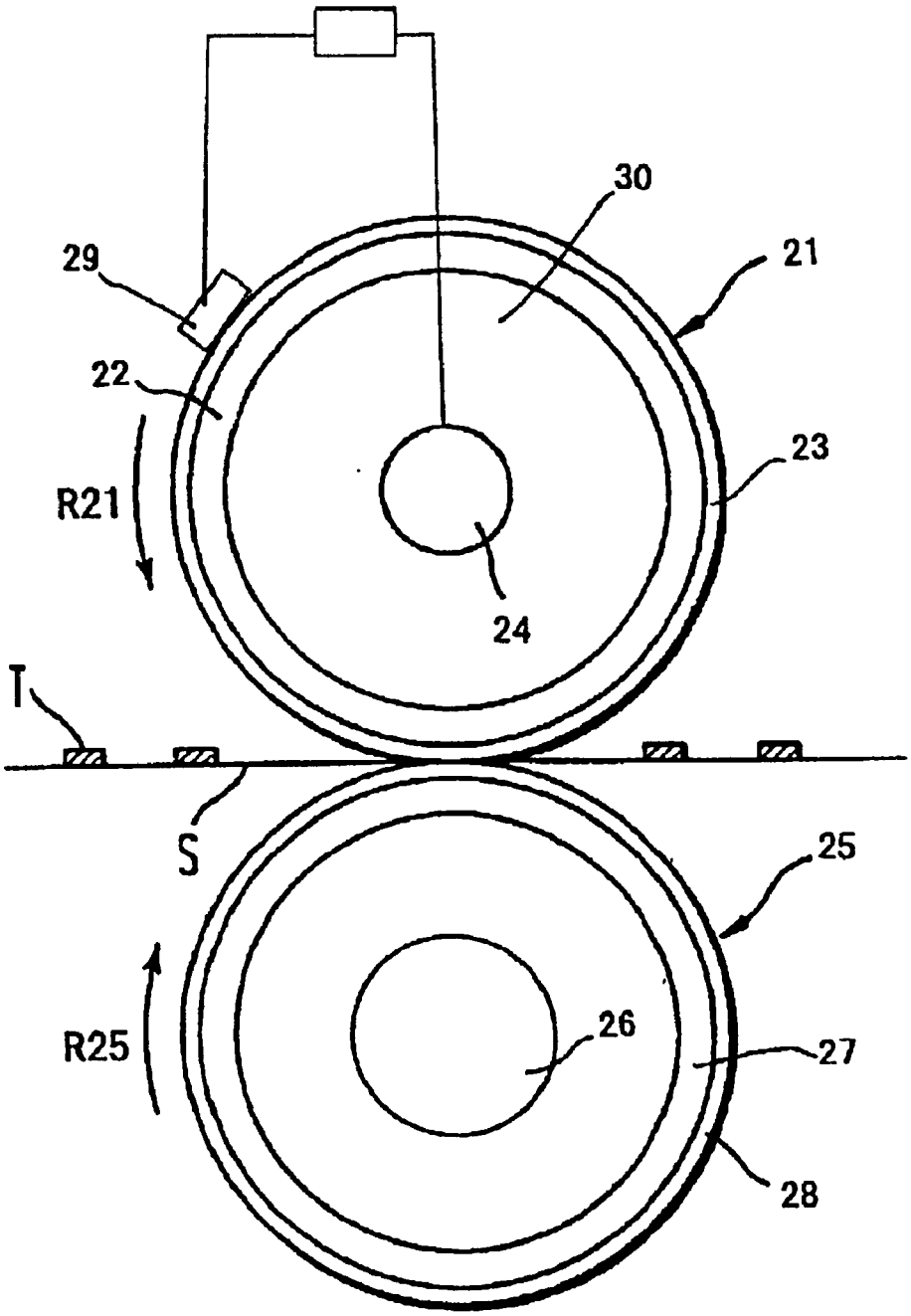
FIG. 3 is a vertical cross-sectional view schematically illustrating another embodiment of a heating roller fixation device for the image forming apparatus of FIG. 1.

Another preferred embodiment of a heating roller fixation device is shown in FIG. 3. In FIG. 3, the reference numeral 21 denotes a fixing roller (heating roller), and numeral 25 denotes a pressure roller. The fixing roller 21 includes a base cylinder 30 made of a heat conductive metal such as aluminum, iron, stainless steel or brass, an elastic layer 22 covering the base cylinder 30 and made of, for example, a silicone rubber, and an offset preventing layer 23 covering the elastic layer 22 and made of a releasing material such as a room temperature vulcanizing (RTV) rubber, a silicone rubber, tetrafluoroethylene-perfluoroalkylvinylether copolymer (PFA) or a polytetrafluoroethylene (PTFE). The thickness of the elastic layer 22 is preferably 100–500 $\mu$m for reasons of formation of high grade fixed images and of suitable heat conductivity, while the thickness of the offset preventing layer 23 is preferably 10–50 μm for reasons of suitable heat conductivity and service life. Disposed in the base cylinder 30 is a heater such as a halogen lamp. A temperature detector 29 is provided for measuring the temperature of the surface of the fixing roller 21. The temperature detector 29 is coupled with the heater 24 through a controller so that the temperature of the fixing roller 21 is maintained at a predetermined range. The pressure roller 25 has a core cylinder 26 made of a metal, an elastic layer 27 covering the core cylinder 26 and made of, for example, a silicone rubber and, optionally, an offset preventing layer 28 covering the elastic layer 27 and made of a releasing material such as PFA. The fixing roller 21 and the pressure roller 25 are in a pressure engagement with each other by a pressing member such as springs (not shown), so that the two rollers rotate in the direction opposite directions as shown by the arrows R21 and R25 by operation of drive means (not shown).

The image forming method according to the first aspect of the present invention includes passing a sheet S having a toner image T formed from a toner including a binder resin and a colorant through the nip between the rollers 1 and 2 in the case of FIG. 2 or rollers 21 and 25 in the case of FIG. 3 so that the toner image T is melted and fixed to the sheet S to form a fixed toner image thereon.

In this case, it is important that a volume change Vt and an area change St defined by the formulas shown below should be 30% or less and 20% or less, respectively:

$$Vt(\%)=(V1-V2)/V1\times 100$$

$$St(\%)=(S2-S1)/S1\times 100$$

wherein

V1 represents a toner volume of the toner image T before the passage through the nip,

V2 represents a toner volume of the toner image T after the passage through the nip,

S1 represents a toner image area of the toner image T before the passage through the nip, and

S2 represents a toner image area of the toner image T after the passage through the nip.

When toner volume change Vt is greater than 30%, a suitable toner image density is not obtainable especially in half tone image portions such as dot image portions in which the amount of the toner is relatively small. When the toner image area change St is greater than 20%, the image quality is deteriorated especially in solid image portions in which the amount of the toner is relatively large.

The area and volume of a toner image before and after the passage through the rollers are measured using a microscope (Color Laser 3D Profile Microscope VK-8500). A circular solid image (before passage through the rollers) formed from a plurality of dots and having a diameter of 2.0 mm and a deposition amount of the toner of 1.2±0.05 mg is observed by the microscope to determine the total area of the dots. The height of the toner image before the passage through the rollers is also measured. The toner volume is calculated on the basis of the height and the total area of the dots thus measured. The circular solid image is then passed through the rollers. The total area of the dots and the height of the toner image after the passage through the rollers are measured, from the results of which the toner volume is calculated.

As described previously, the fixation efficiency of small diameter toner is not high because a pressure is not easily applied to the toner particles during fixation step. When a high pressure is applied to improve the fixation efficiency, the toner image is crushed to cause deterioration of the image. It has been found that when the volume change Vt and the area change St are 30% or less and 20% or less, respectively, high grade images (with small granularity) may be produced with high fixation efficiency. It has been also found that not only the fixing pressure (surface pressure) in a heating roller fixation device, the hardness of the rollers thereof and the thickness of the toner image bearing sheet but also the composition and physical properties of the toner play an important role in controlling the volume change Vt and the area change St. In particular, the melt viscosity, the content of tetrahydrofuran (THF) insolubles, the acid value of the toner binder, a magnetic material, an inorganic fine powder and an organozirconium compound of the toner have been found to have an influence upon the volume change Vt and the area change St.

It is preferred that at least one of two rollers of the heating roller fixation device have an elastic layer for reasons of easiness in controlling the fixing pressure (surface pressure) and of ensuring the suitable volume change Vt and the area change St.

It is preferred that the toner used in the image forming method of the present invention have a ratio $\eta_{100}/\eta_{120}$ of the viscosity $\eta_{100}$ of the toner at 100° C. to the viscosity $\eta_{120}$ of the toner at 120° C. ranges from 6 to 10 for reasons of attainment of the suitable volume change Vt and the area change St and the suitable fixation efficiency.

The melt viscosity $\eta_{100}$ at 100° C. is preferably in the range of $1\times10^5$ to $4\times10^5$ Pa·s and the melt viscosity $\eta_{120}$ at 120° C. is preferably in the range of $1\times10^4$ to $4\times10^5$ Pa·s for reasons of attainment of the suitable volume change Vt and the area change St and the suitable fixation efficiency. The melt viscosity of the toner is measured using a commercially available flow tester "CFT-500C" made by Shimadzu Corporation. The measuring conditions are as follows:

Extruding pressure: 1.9612 Mpa
Heating speed: 6° C./min
Diameter of a die: 1.0 mm
Length of the die: 1.0 mm The melt viscosity η is obtained by the following equation:

$$\eta=\tau/\gamma=\pi D^4P/128LQ$$

$$Q=X/10\times A/t$$

wherein P is an extruding pressure (Pa), D is a diameter (mm) of the die used, L is a length (mm) of the die used, t is a measuring time (s), X is a displacement (mm) of a piston during the measuring time t and A is a cross-sectional area ($cm^2$) of the piston.

It is preferred that the binder resin of the toner have a THF-insoluble content of 10 to 80% by weight for reasons of attainment of the suitable volume change Vt and the area change St and the suitable fixation efficiency.

A polyester resin which permits fixation at a lower temperature while maintaining suitable heat resistance and preservability as compared with other resins is suitably used as a binder resin of the toner of the present invention. In this case, it is also preferred that the binder resin comprise at least 50% by weight of a polyester resin having an acid value of 10 to 100 mgKOH/mg for reasons of stable chargeability, compatibility with other ingredients of the toner, dispersibility in the toner and small environment denpendency of the charge amount of the toner.

Suitable polyester resins for use in the toner of the present invention include those which are prepared by condensation polymerization of an alcohol and a carboxylic acid. Specific examples of such alcohols for use in the polyester resins include glycols such as ethylene glycol, diethylene glycol, triethylene glycol and propylene glycol; 1,4-bis (hydroxymetha)cyclohexane, etherificated bisphenols such as bisphenol A, dihydric alcohol monomers, and polyhydric alcohol monomers. Specific examples of the carboxylic acids for use in the polyester resins include organic dibasic acid monomers such as maleic acid, fumaric acid, phthalic acid, isophthalic acid, terephthalic acid, succinic acid, malonic acid; and polybasic carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxylpropane, and 1,2,7,8-octanetetracarboxylic acid. The use of a polyester resin having a glass transition temperature Tg of from 58 to 75° C. is preferred.

It is preferred that the polyester resin having an acid value of 10 to 100 mgKOH/mg (first resin) be used in conjunction with no more than 50% by weight of another resin (second resin) which is not compatible with the first polyester resin. By virtue of the conjoint use, there is obtainable a filler effect and, additionally, a reduction of volume change Vt and area change St and an improvement of fixation efficiency. The second resin may suitably be a polyester resin whose physical properties such as glass transition point Tg, molecular weight and/or acid value are different from those of the first resin.

In the toner of the present invention, the polyester resin may be employed in conjunction with one or more other resins. Specific examples of such resins include homopolymers or copolymers of styrene or its homologues such as polystyrene, poly-α-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers, styrene-methacrylate copolymers, styrene-α-chloroacrylic acid methyl ester copolymers, and styrene-acrylonitrile-acrylate copolymers; vinyl chloride resins, rosin modified maleic acid resins, phenolic resins, polyethylene resins, polypropylene resins, petroleum resins, polyurethane resins, ketone resins, ethylene-ethylacrylate copolymers, xylene resins, and polyvinyl butyral resins. These resins may be used alone or in combination. The method for manufacturing these resins is not particularly limited, and known polymerization methods such as bulk polymerization, solution polymerization, emulsion polymerization, and suspension polymerization can be employed to prepare these resins.

It is preferred that the toner according to the present invention contain a fine powder of a magnetic material such as iron oxide, magnetite or ferrite for reasons of obtaining a filler effect and a reduction of volume change Vt and area change St. The magnetic material is generally used in an amount of 5–60% by weight, preferably 10–40% by weight, based on a total weight of the binder resin.

It is also preferred that the toner according to the present invention contain inorganic powder such as silica, aluminum oxide or titanium oxide as an internal additive for reasons of obtaining a filler effect and a reduction of the volume change Vt and area change St. The average particle size of the inorganic powder is generally in the range of 0.001 to 1 μm, preferably 0.005 to 0.1 μm. Such particles may be combined to form secondary particles, if desired. The inorganic powder is generally used in an amount of 0.1 to 10% by weight, preferably 0.2 to 5% by weight, based on the weight of the toner.

The toner of the present invention may preferably contain a charge controlling agent such as a nigrosine dye, a quarternary ammonium salt, an amino group-containing polymer, a metal-containing azo dye, a complex containing salicylic acid group or a phenol compound.

An organic zirconium compound is especially suitably used as a charge controlling agent for reasons of obtaining a reduction of the volume change Vt and area change St. Although not wishing to be bound by the theory, the effect of the organic zirconium compound is considered to be attributed to the formation of crosslinkages between the organic zirconium compound and reactive groups of the binder resin. The organic zirconium compound may be a compound containing a zirconium or oxyzirconium and an aromatic oxycarboxylic acid or a salt thereof. The amount of the organic zirconium compound is generally 0.01 to 10 parts by weight, preferably 0.5 to 5 parts by weight, per 100 parts by weight of the binder resin.

The organic zirconium compound is preferably a compound represented by the following formula:

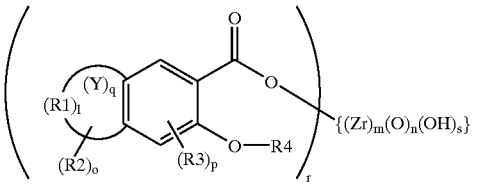

wherein R1 represents a quarternary carbon atom, a metyne group or a methylene group which may contain a heteroatom such as N, S, O or P, Y contains one or more saturated and/or unsaturated bonds which define, together with R1, a ring fused to the benzene ring of the above formula, R2 and R3 are independently selected from alkyl, alkenyl, alkoxy, aryl which may contain one or more substituents, aryloxy which may contain one or more substituents, aralkyl which may contain one or more substituents, aralkyloxy which may contain one or more substituents, halogene, hydrogen, hydroxyl, amino which may contain one or more substituents, carboxyl, carbonyl, nitro, nitroso, sulfonyl and cyano, R4 represents a hydrogen atom or an alkyl group, 1 is an integer of 0 or 3 to 12, m is an integer of 1 to 20, n is an integer of 0 to 20, o is an integer of 0 to 4, p is an integer of 0 to 4, q is an integer of 0 to 3, r is an integer of 1 to 20 and s is an integer of 0 to 20.

Inorganic fine particles may be suitably used, as an external additive, to improve the fluidity, developing efficiency and chargeability of the toner by being attached to outer surfaces of the toner particles. Such inorganic fine particles include silica, alumina, titanium oxide, barium titanate, magnesium titanate, calcium titanate, strontium titanate, zinc oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle diameter of 5 nm to 2 μm, more preferably 5 nm to 500 nm, and a BET specific surface area of 20–500 $m^2/g$. The inorganic fine particles are used in an amount of generally 0.01 to 5% by weight, preferably 1 to 5% by weight, more preferably 1 to 3% by weight, based on the weight of the toner, for reasons of reducing the volume change Vt and area change St.

By subjecting these fluidizing agents to a surface treatment to improve the hydrophobic properties thereof, deterioration of the fluidity and the charge properties of the toner can be avoided even under high humidity conditions. Suitable surface treating agents include silane coupling agents, silane coupling agents having a fluorinated alkyl group, organic titanate type coupling agents, aluminum type coupling agents, silicone oil and modified silicone oil.

It is also preferred that the toner have a weight average particle diameter of 4 to 10 μm for reasons of obtaining suitable volume change Vt and area change St. The weight average particle diameter is measured using COULTER COUNTER TA-II or Coulter Multisizer II (manufactured by Coulter Electronics Inc.) with an aperture having a diameter of 100 μm.

It is preferred that the toner contain a wax to improve the release properties of toner images from a heating roller of the fixation device. Illustrative of suitable waxes are polyolefin waxes such as propylene wax and polyethylene wax and vegetable waxes such as candelilla wax, carnauba wax and rice wax. The amount of the wax is generally 0.5 to 10% by weight based on the weight of the binder resin.

Any conventionally employed colorant may be suitably used for the purpose of the present invention. Specific examples of such pigments and dyes include carbon black, lamp black, iron black, ultramarine blue, Nigrosine dyes, Aniline Blue, chalco-oil blue, Oil Black and azo oil black. The amount of the colorant is generally 1 to 10 parts by weight, preferably 3 to 7 parts by weight, per 100 parts by weight of the binder resin.

The toner of the present invention can be prepared by any conventionally-known method such as a pulverization method in which a kneaded mixture containing ingredients of the toner is solidified and ground. The ingredients may be suitably blended using a HENSCHEL MIXER or the like before kneading. The thus obtained kneaded mixture is cooled and ground. The grinding may be performed by a combination of a coarse pulverization with a hammer mill, Rotoplex (a grinder manufactured by Hosokawa Micron Co., Ltd.) or the like and succeeding fine pulverization with a jet air pulverizer or a mechanical pulverizer. When necessary depending upon the particle size distribution of the obtained toner, the toner will be adjusted to have a desired particle size distribution by an air classifier or the like.

When the toner of the present invention is employed as a two-component developer, any conventionally-known carrier can be used. In this case, the toner is generally used in an amount of 1–10 parts by weight per 100 parts by weight of the carrier. Illustrative of suitable carrier are powders of glass, iron, ferrite, nickel, zircon or silica, which have a particle diameter of from 30 to 1000 μm. These powders may be coated with a resin such as a styrene-acrylate copolymer, a silicone resin, a polyamide resin or a polyvinylidene fluoride resin.

Next, description will be made of the second aspect of the present invention.

In an image forming method according to the second aspect of the present invention, a sheet S having a toner image T formed from a toner including a binder resin and a colorant is passed through the nip between the rollers 1 and 2 in the case of FIG. 2 or rollers 21 and 25 in the case of FIG. 3 so that the toner image T is melted and fixed to the sheet S to form a fixed toner image thereon. In this case, toner image T before the passage through the nip preferably has a surface roughness of 2.5 μm or less for reasons of uniformity of the image density and gloss.

As used herein, the surface roughness Ra of the toner image refers to a roughness as measured by a microscope (Color Laser 3D Profile Microscope VK-8500 manufactured by Keyence Inc.) in accordance with JIS B0601. More specifically, the surface roughness Ra is given by the following equation in μm:

$$Ra=1/L\times\int_o^L|f(x)|d\,x$$

wherein L is a reference length over which a roughness curve is extracted in the direction of average line. The roughness curve is expressed by a function y=f(x) when the X axis is taken in the direction of the average line of the extracted portion and the Y axis is taken in the direction of vertical magnification. The reference length L of 0.8 mm is employed.

It is preferred that at least one of the two rollers of the heating roller fixing device used for carrying out the method according to the second aspect of the present invention is elastic for reasons of improved fixation efficiency and of uniformity of the image density and gloss. When at least one of the two rollers has a rigid surface, the toner image before the passage through said nip preferably has a surface roughness of 2.0 μm or less for the same reasons.

It is also preferred that the toner used in the second aspect of the present invention have an average sphericity of at least 0.92, more preferably at least 0.95 for reasons of obtaining small surface roughness Ra and low granularity. The sphericity of the toner particles may be increased by grinding or by a heat treatment.

The sphericity as used herein is measured using a flow particle image analyzer, "FPIA-2100", manufactured by SYSMEX Co., Ltd.). A 1% NaCl aqueous solution (50 to 100 ml) after being passed through a 0.45 μm filter is mixed with 0.1 to 5 ml of a surfactant (preferably a salt of alkylbenzenesulfonate). To the resulting solution, 1 to 10 mg of a sample is added. This is subjected to a dispersion treatment for 1 minute with an ultrasonic disperser to form a sample dispersion liquid having a concentration of 5000 to 15000 particles/μl. The sample dispersion liquid is measured for the average sphericity of particles having a circle-equivalent diameter of not smaller than 0.60 μm using the above flow type particle image analyzer. From the area of the two-dimensional image of each of the particles measured with a CCD camera, a diameter of a circle having the same area is calculated as a circle-equivalent diameter of the particle. The average sphericity is calculated by dividing a sum of the circle-equivalent diameters of the particles by the number of the particles.

It is also preferred that the toner used in the second aspect of the present invention have a bulk density of at least 0.30 g/cm$^3$ for reasons of obtaining suitable surface roughness Ra of the toner image before the fixation. The bulk density of the toner is measured using a powder tester (model PTN manufactured by Hosokawa Micron Inc.).

Inorganic fine particles may be suitably used, as an external additive, to improve the fluidity, developing efficiency and chargeability of the toner used in the second aspect of the present invention by being attached to outer surfaces of the toner particles. Such inorganic fine particles include silica, alumina, titanium oxide, barium titanate, magnesium titanate, calcium titanate, strontium titanate, zinc oxide, quartz sand, clay, mica, wallstonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. These inorganic fine particles preferably have a primary particle diameter of 5 nm to 2 μm, more preferably 5 nm to 500 nm, and a BET specific surface area of 20–500 m$^2$/g. The inorganic fine particles are used in an amount of generally 0.01 to 5% by weight, preferably 1 to 5% by weight, more preferably 1 to 3% by weight, based on the weight of the toner, for reasons of obtaining suitable surface roughness Ra of the toner image before the fixation as well as improved fluidity, developing efficiency and chargeability of the toner.

It is also preferred that the ratio Xw/Xn of the weight average particle diameter Xw of the toner to the number average particle diameter Xn thereof be 1.3 or less for reasons of obtaining suitable surface roughness Ra of the toner image before the fixation.

It is also preferred that the toner used in the second aspect of the present invention have a weight average particle diameter of 4 to 10 μm, more preferably 4 to 8 μm, most preferably 4 to 6 μm for reasons of obtaining both suitable fixation efficiency and suitable resolution of the fixed toner image. The weight average particle diameter is measured using COULTER COUNTER TA-II or Coulter Multisizer II (manufactured by Coulter Electronics Inc.) with an aperture having a diameter of 100 μm.

In the image forming method according to the second aspect of the present invention, the developed toner image on the photoconductor is preferably brought into direct contact a transfer sheet to transfer the toner image from the photoconductor to the sheet. In comparison with a non-contact type image transfer method in which corona discharge is used for transferring a toner image from a photoconductor to a transfer sheet, such a contact type transfer method is more preferred for reasons of obtaining smaller surface roughness Ra of the toner image before the fixation.

Any conventionally employed binder resin may be used in the toner of the second aspect of the present invention. Specific examples of such binder resins include homopolymers or copolymers of styrene or its homologues such as polystyrene, poly-α-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers, styrene-methacrylate copolymers, styrene-α-chloroacrylic acid methyl ester copolymers, and styrene-acrylonitrile-acrylate copolymers; vinyl chloride resins, rosin modified maleic acid resins, phenolic resins, polyethylene resins, polypropylene resins, petroleum resins, polyurethane resins, ketone resins, ethylene-ethylacrylate copolymers, xylene resins, polyester resins and polyvinyl butyral resins.

Above all, the use of a polyester resin as the binder resin is preferred. Suitable polyester resins for use in the toner of the present invention include those which are prepared by condensation polymerization of an alcohol and a carboxylic acid. Specific examples of such alcohols for use in the polyester resins include glycols such as ethylene glycol, diethylene glycol, triethylene glycol and propylene glycol; 1,4-bis(hydroxymetha)cyclohexane, etherificated bisphenols such as bisphenol A, dihydric alcohol monomers, and polyhydric alcohol monomers. Specific examples of the carboxylic acids for use in the polyester resins include organic dibasic acid monomers such as maleic acid, fumaric acid, phthalic acid, isophthalic acid, terephthalic acid, succinic acid, malonic acid; and polybasic carboxylic acid monomers such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxylpropane, and 1,2,7,8-octanetetracarboxylic acid. The use of a polyester resin having a glass transition temperature Tg of from 58 to 75° C. is preferred.

These resins may be used alone or in combination. The method for manufacturing these resins is not particularly limited, and known polymerization methods such as bulk polymerization, solution polymerization, emulsion polymerization, and suspension polymerization can be employed to prepare these resins.

It is preferred that the toner used in the image forming method according to the second aspect of the present invention contain a wax to improve the release properties of toner images from a heating roller of the fixation device. Illustrative of suitable waxes are polyolefin waxes such as propylene wax and polyethylene wax and vegetable waxes such as candelilla wax, carnauba wax and rice wax. The amount of the wax is generally 0.5 to 10% by weight based on the weight of the toner.

The toner used in the image forming method according to the second aspect of the present invention may preferably contain a charge controlling agent such as a nigrosine dye, a quarternary ammonium salt, an amino group-containing polymer, a metal-containing azo dye, a complex containing salicylic acid group or a phenol compound.

Any conventionally employed colorant may be suitably used for the purpose of the present invention. Specific examples of such pigments and dyes include carbon black, lamp black, iron black, ultramarine blue, Nigrosine dyes, Aniline Blue, chalco-oil blue, Oil Black and azo oil black. The amount of the colorant is generally 1 to 10 parts by weight, preferably 3 to 7 parts by weight, per 100 parts by weight of the toner.

It is also preferred that the toner used in the image forming method according to the second aspect of the present invention contain inorganic powder such as silica, aluminum oxide or titanium oxide as an internal additive for reasons of obtaining a filler effect. The average particle size of the inorganic powder is generally in the range of 0.001 to 1 μm, preferably 0.005 to 0.1 μm. Such particles may be combined to form secondary particles, if desired. The inorganic powder is generally used in an amount of 0.1 to 5% by weight, preferably 0.2 to 2% by weight, based on a total weight of the toner.

The toner used in the image forming method according to the second aspect of the present invention can be prepared by any suitable known method including the method described above in connection with the first aspect of the present invention and may be employed as a two-component developer in combination with a conventionally-known carrier as described above in connection with the first aspect of the present invention.

The following examples will further illustrate the present invention. Parts are by weight.

EXAMPLE 1

| | |
|---|---|
| Styrene-n-butyl acrylate copolymer (weight average molecular weight: 253,000) | 75 parts |
| Styrene-n-butyl methacrylate copolymer (weight average molecular weight: 23,000) | 10 parts |
| Carbon black (trade name: #44, manufactured by Mitsubishi Chemical Corp. | 10 parts |
| Charge controlling agent (trade name: Spiron Black TR-H, manufactured by Hodogaya Chemical Corp.) | 2 parts |
| Low molecular weight polyethylene | 3 parts |

The above components were mixed using a two axis kneader at 40° C. The kneaded mixture was cooled, pulverized and classified. The thus obtained mother toner had a weight average particle diameter of 10.5 μm. To the mother toner particles, 0.4 part of hydrophobic silica (R972 manufactured by Clariant Japan) as an external additive was mixed using HENSCHEL MIXER to obtain Toner (1). The Toner (1) was then mixed with a carrier which was obtained by coating ferrite particles having an average particle diameter of 80 μm with a silicone resin to obtain a Developer (1) having a toner content of 4% by weight. The Toner (1) was measured for the melt viscosity $\eta_{100}$ at 100° C. and the melt viscosity $\eta_{120}$ at 120° C., from which the ratio $\eta_{100}/\eta_{120}$ was calculated. Using the Developer (1), the volume change Vt, the area change St, the fixation efficiency and the granularity of the Toner (1) were measured according to the following methods. The results are summarized in Table 1.

Volume Change Vt and Area Change St:

A heating roller fixation device as shown in FIG. 3 is mounted on a commercially available copying machine (IMAGIO MF6550 manufactured by Ricoh Company, Ltd.) to which the Developer (1) is charged. Images of a standard printer test chart are formed using the copying machine. A toner volume V1 and a toner image area S1 before the passage through the fixing device and a toner volume V2 and a toner image area S2 after the passage through the fixing device are measured, from which the volume change Vt and the area change St are calculated. The toner image area of a toner image before and after the passage through the rollers is measured using a microscope (Color Laser 3D Profile Microscope VK-8500). A circular solid image (before passage through the rollers) formed from a plurality of dots and having a diameter of 2.0 mm and a deposition amount of the toner of 1.2±0.05 mg is observed by the microscope to determine the total area of the dots. The height of the toner image before the passage through the rollers is also measured. The toner volume is calculated on the basis of the height and the total area of the dots thus measured. Similar measurement is carried out on the toner image after the passage through the rollers.

Fixation Efficiency:

A heating roller fixation device as shown in FIG. 3 is mounted on a commercially available copying machine (IMAGIO MF6550 manufactured by Ricoh Company, Ltd.) to which the Developer (1) was charged. The fixation efficiency is measured by the following method.

(1) an image is produced using the above copying machine at a given fixing temperature and density D1 of the fixed toner image is measured;
(2) a piece of an adhesive tape (Scotch Mending Tape manufactured by Sumitomo 3M Limited) is attached on the fixed image with a predetermined pressure;
(3) the tape is then slowly peeled;
(4) the image density D2 of the image remaining after the removal of the tape is measured;
(5) the fixation is calculated according to the following equation:

$$\text{Fixation } (\%)=(D2/D1)\times 100$$

wherein D1 and D2 are as defined above;

(6) the above procedures (1) through (5) are repeated in the same manner as described except that the fixing temperature is gradually lowered;
(7) the fixing temperature ($F_{80}$) below which the fixation is less than 80% is determined.

The fixation efficiency is evaluated in terms of the fixing temperature $F_{80}$. The lower the fixing temperature $F_{80}$, the better is the fixation efficiency.

Granularity:

A heating roller fixation device as shown in FIG. 3 is mounted on a commercially available copying machine (IMAGIO MF6550 manufactured by Ricoh Company, Ltd.). Using the Developer (1), fixed image is produced at a fixing temperature higher by 10° C. than the fixation temperature $F_{80}$. A half tone portion (gray scale formed by a plurality of dots) of the fixed image are read using a scanner (GenaScan 5000 manufactured by Dai Nippon Screen Co., Ltd.) at 1,000 dpi to obtain image data. The data are converted into distribution of image density from which granularity (GS) is calculated according to the following formula (1):

$$GS=\exp(-1.8\langle D\rangle)\int WS(u)^{1/2}VTF(u)du \quad (1)$$

wherein <D> represents an average image density, WS represents Wiener spectrum, VTF represents a visual transfer function and u represents a spatial frequency.

The granularity GS is generally used to evaluate the image quality and is concerned with the subjective evaluation of smoothness and roughness of an image. The smaller the granularity value, the smoother becomes the image. Conversely speaking, an image with a large granularity value is high in roughness and poor in the image quality. Noise may be measured by Wiener spectrum which represents frequency characteristics of the image density variation and which may be expressed by:

$$WS(u)=F(u)^2 \quad (2)$$

$$F(u)=\int g(x)\exp(-2\pi iux)dx \quad (3)$$

wherein u is as defined above and g(x) represents an image density variation component the average of which is 0. In the above equation (1), exp(−1.8<D>) represents a coefficient for compensating a difference between the image density and the brightness sensed by human observers.

The granularity is described in "Fine Imaging and Hard Copy", p. 506–513, edited by Japan Photography Association, published by Corona Corporation; and "The Theory of the Photographic Process"; 4th Edition, page 619, the disclosure of which is hereby incorporated by reference herein.

COMPARATIVE EXAMPLE 1

| | |
|---|---|
| Styrene-butyl acrylate copolymer (weight average molecular weight: 153,000) | 85 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Low molecular weight polyethylene | 3 parts |

Using the above composition, the procedures of Example 1 were repeated in the same manner as described except that the kneading temperature was increased to 120° C. The thus obtained toner (Toner C1) was measured for the melt viscosity $\eta_{100}$, melt viscosity $\eta_{120}$, the volume change Vt, the area change St, the fixation efficiency and the granularity in the same manner as that described in Example 1 except that a heating roller fixation device (surface pressure: $1.0\times10^5$ Pa·s) as shown in FIG. 2 was substituted for the fixation device as shown in FIG. 3. The results are shown in Table 1.

COMPARATIVE EXAMPLE 2

| | |
|---|---|
| Styrene-butyl acrylate copolymer (weight average molecular weight: 325,000) | 85 parts |
| Carbon black (trade name: #44, manufactured by Mitsubishi Chemical Corp.) | 10 parts |

-continued

| | |
|---|---|
| Charge controlling agent (trade name: Spiron Black TR-H, manufactured by Hodogaya Chemical Corp.) | 2 parts |
| Low molecular weight polyethylene | 3 parts |

Using the above composition, the procedures of Example 1 were repeated in the same manner as described except that the kneading temperature was increased to 150° C. The thus obtained toner (Toner C2) was measured for the melt viscosity $\eta_{100}$, melt viscosity $\eta_{120}$, the volume change Vt, the area change St, the fixation efficiency and the granularity in the same manner as that described in Example 1 except that a heating roller fixation device (surface pressure: $1.0\times10^5$ Pa·s) as shown in FIG. 2 was substituted for the fixation device as shown in FIG. 3. The results are shown in Table 1. The results are shown in Table 1.

COMPARATIVE EXAMPLE 3

| | |
|---|---|
| Styrene-butyl acrylate copolymer (weight average molecular weight: 121,000) | 85 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Low molecular weight polyethylene | 3 parts |

Using the above composition, the procedures of Example 1 were repeated in the same manner as described except that the kneading temperature was increased to 90° C. The thus obtained toner (Toner C3) was measured for the melt viscosity $\eta_{100}$, melt viscosity $\eta_{120}$, the volume change Vt, the area change St, the fixation efficiency and the granularity in the same manner as that described in Example 1 except that a heating roller fixation device (surface pressure: $1.0\times10^5$ Pa·s) as shown in FIG. 2 was substituted for the fixation device as shown in FIG. 3. The results are shown in Table 1. The results are shown in Table 1.

COMPARATIVE EXAMPLE 4

| | |
|---|---|
| Styrene-butyl acrylate copolymer (weight average molecular weight: 153,000) | 85 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Low molecular weight polyethylene | 3 parts |

Using the above composition, the procedures of Example 1 were repeated in the same manner as described except that the kneading temperature was increased to 80° C. The thus obtained toner (Toner C4) was measured for the melt viscosity $\eta_{100}$, melt viscosity $\eta_{120}$, the volume change Vt, the area change St, the fixation efficiency and the granularity in the same manner as that described in Example 1. The results are shown in Table 1.

COMPARATIVE EXAMPLE 5

| | |
|---|---|
| Styrene-butyl acrylate copolymer (weight average molecular weight: 216,000) | 85 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Low molecular weight polyethylene | 3 parts |

Using the above composition, the procedures of Example 1 were repeated in the same manner as described except that the kneading temperature was increased to 110° C. The thus obtained toner (Toner C5) was measured for the melt viscosity $\eta_{100}$, melt viscosity $\eta_{120}$, the volume change Vt, the area change St, the fixation efficiency and the granularity in the same manner as that described in Example 1. The results are shown in Table 1.

COMPARATIVE EXAMPLE 6

| | |
|---|---|
| Styrene-butyl acrylate copolymer (weight average molecular weight: 105,000) | 85 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Low molecular weight polyethylene | 3 parts |

Using the above composition, the procedures of Example 1 were repeated in the same manner as described except that the kneading temperature was increased to 60° C. The thus obtained toner (Toner C6) was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 2

| | |
|---|---|
| Styrene-butyl acrylate copolymer (weight average molecular weight: 350,000) | 50 parts |
| Styrene-n-butyl methacrylate copolymer (weight average molecular weight: 39,000) | 33 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Carnauba wax | 5 parts |

The above components were mixed using a two axis kneader at 110° C. The kneaded mixture was cooled, pulverized and classified. The thus obtained mother toner had a weight average particle diameter of 10.5 $\mu$m. To the mother toner particles, 0.4 part of hydrophobic silica (R972 manufactured by Clariant Japan) as an external additive was mixed using HENSCHEL MIXER to obtain Toner (2). The Toner (2) was then mixed with a carrier which was obtained by coating ferrite particles having an average particle diameter of 80 $\mu$m with a silicone resin to obtain a Developer (2) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 3

| | |
|---|---|
| Styrene-butyl acrylate copolymer (weight average molecular weight: 280,000) | 53 parts |
| Styrene-2-ethylhexyl acrylate-n-butyl methacrylate terpolymer (weight average molecular weight: 31,000) | 30 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Carnauba wax | 5 parts |

The above components were mixed using a two axis kneader at 100° C. The kneaded mixture was cooled, pulverized and classified. The thus obtained mother toner had a weight average particle diameter of 10.5 μm. To the mother toner particles, 0.4 part of hydrophobic silica (R972 manufactured by Clariant Japan) as an external additive was mixed using HENSCHEL MIXER to obtain Toner (3). The Toner (3) was then mixed with a carrier which was obtained by coating ferrite particles having an average particle diameter of 80 μm with a silicone resin to obtain a Developer (3) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 4

| | |
|---|---|
| Polyester resin (weight average molecular weight: 182,000, THF insoluble content: 20% by weight, acid value: 3 mgKOH/mg) | 68 parts |
| Polyester resin (weight average molecular weight: 53,000, THF insoluble content: 0, acid value: 5 mgKOH/mg) | 15 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Rice wax | 5 parts |

The above components were mixed using a two axis kneader at 60° C. The kneaded mixture was cooled, pulverized and classified. The thus obtained mother toner had a weight average particle diameter of 10.5 μm. To the mother toner particles, 0.4 part of hydrophobic silica (R972 manufactured by Clariant Japan) as an external additive was mixed using HENSCHEL MIXER to obtain Toner (4). The Toner (4) was then mixed with a carrier which was obtained by coating ferrite particles having an average particle diameter of 80 μm with a silicone resin to obtain a Developer (4) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 5

| | |
|---|---|
| Polyester resin (weight average molecular weight: 75,000, THF insoluble content: 40% by weight) | 60 parts |
| Styrene-butyl acrylate copolymer (weight average molecular weight: 71,000, THF insoluble content: 25% by weight) | 20 parts |
| Hydrophobic silica (R972 manufactured by Clariant Japan) | 3 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Carnauba wax | 5 parts |

The above components were mixed using a two axis kneader at 100° C. The kneaded mixture was cooled, pulverized and classified. The thus obtained mother toner had a weight average particle diameter of 10.5 μm. To the mother toner particles, 0.4 part of hydrophobic silica (R972 manufactured by Clariant Japan) as an external additive was mixed using HENSCHEL MIXER to obtain Toner (5). The Toner (5) was then mixed with a carrier which was obtained by coating ferrite particles having an average particle diameter of 80 μm with a silicone resin to obtain a Developer (5) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 6

| | |
|---|---|
| Polyester resin (weight average molecular weight: 142,000, THF insoluble content: 10% by weight) | 60 parts |
| Styrene-butyl acrylate copolymer (weight average molecular weight: 45,000, THF insoluble content: 15% by weight) | 20 parts |
| Hydrophobic silica (R972 manufactured by Clariant Japan) | 3 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Carnauba wax | 5 parts |

The above components were mixed using a two axis kneader at 90° C. The kneaded mixture was cooled, pulverized and classified. The thus obtained mother toner had a weight average particle diameter of 10.5 μm. To the mother toner particles, 0.4 part of hydrophobic silica (R972 manufactured by Clariant Japan) as an external additive was mixed using HENSCHEL MIXER to obtain Toner (6). The Toner (6) was then mixed with a carrier which was obtained by coating ferrite particles having an average particle diameter of 80 μm with a silicone resin to obtain a Developer (6) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 7

| | |
|---|---|
| Polyester resin (weight average molecular weight: 182,000, THF insoluble content: 5% by weight, acid value: 35 mgKOH/mg) | 68 parts |
| Polyester resin (weight average molecular weight: 53,000, THF insoluble content: 0, acid value: 5 mgKOH/mg) | 15 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Rice wax | 5 parts |

The above components were mixed using a two axis kneader at 60° C. The kneaded mixture was cooled, pulverized and classified. The thus obtained mother toner had a weight average particle diameter of 10.5 $\mu$m. To the mother toner particles, 0.4 part of hydrophobic silica (R972 manufactured by Clariant Japan) as an external additive was mixed using HENSCHEL MIXER to obtain Toner (7). The Toner (7) was then mixed with a carrier which was obtained by coating ferrite particles having an average particle diameter of 80 $\mu$m with a silicone resin to obtain a Developer (7) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 8

| | |
|---|---|
| Polyester resin (weight average molecular weight: 182,000, THF insoluble content: 20% by weight) | 63 parts |
| Styrene-butyl acrylate copolymer (weight average molecular weight: 71,000, THF insoluble content: 25% by weight) | 20 parts |
| Hydrophobic silica (R972 manufactured by Clariant Japan) | 3 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Carnauba wax | 5 parts |

The above components were mixed using a two axis kneader at 120° C. The kneaded mixture was cooled, pulverized and classified. The thus obtained mother toner had a weight average particle diameter of 10.5 $\mu$m. To the mother toner particles, 0.4 part of hydrophobic silica (R972 manufactured by Clariant Japan) as an external additive was mixed using HENSCHEL MIXER to obtain Toner (8). The Toner (8) was then mixed with a carrier which was obtained by coating ferrite particles having an average particle diameter of 80 $\mu$m with a silicone resin to obtain a Developer (8) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 9

| | |
|---|---|
| Styrene-butyl acrylate copolymer (weight average molecular weight: 280,000) | 45 parts |
| Styrene-2-ethylhexyl acrylate-n-butyl methacrylate terpolymer (weight average molecular weight: 31,000) | 15 parts |
| Magnetic material (EPT-1000 manufactured by Toda Kogyou Co., Ltd.) | 30 parts |
| Carbon black (trade name: #44, manufactured by Mitsubishi Chemical Corp.) | 5 parts |
| Charge controlling agent (trade name: Spiron Black TR-H, manufactured by Hodogaya Chemical Corp.) | 2 parts |
| Carnauba wax | 3 parts |

The above components were mixed using a two axis kneader at 130° C. The kneaded mixture was cooled, pulverized and classified. The thus obtained mother toner had a weight average particle diameter of 10.5 $\mu$m. To the mother toner particles, 0.4 part of hydrophobic silica (R972 manufactured by Clariant Japan) as an external additive was mixed using HENSCHEL MIXER to obtain Toner (9). The Toner (9) was then mixed with a carrier which was obtained by coating ferrite particles having an average particle diameter of 80 $\mu$m with a silicone resin to obtain a Developer (9) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 10

| | |
|---|---|
| Polyester resin (weight average molecular weight: 88,000, THF insoluble content: 55% by weight) | 60 parts |
| Styrene-butyl acrylate copolymer (weight average molecular weight: 59,000, THF insoluble content: 45% by weight) | 20 parts |
| Hydrophobic silica (R972 manufactured by Clariant Japan) | 3 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Carnauba wax | 5 parts |

The above components were mixed using a two axis kneader at 120° C. The kneaded mixture was cooled, pulverized and classified. The thus obtained mother toner had a weight average particle diameter of 10.5 $\mu$m. To the mother toner particles, 0.4 part of hydrophobic silica (R972 manufactured by Clariant Japan) as an external additive was mixed using HENSCHEL MIXER to obtain Toner (10). The Toner (10) was then mixed with a carrier which was obtained by coating ferrite particles having an average particle diameter of 80 $\mu$m with a silicone resin to obtain a Developer (10) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 11

| | |
|---|---|
| Polyester resin (weight average molecular weight: 182,000, THF insoluble content: 30% by weight, acid value: 55 mgKOH/mg) | 83 parts |
| Carbon black (trade name: #44, manufactured by Mitsubishi Chemical Corp.) | 10 parts |
| Charge controlling agent (organozirconium compound) | 2 parts |
| Carnauba wax | 5 parts |

The above components were mixed using a two axis kneader at 130° C. The kneaded mixture was cooled, pulverized and classified. The thus obtained mother toner had a weight average particle diameter of 10.5 μm. To the mother toner particles, 0.4 part of hydrophobic silica (R972 manufactured by Clariant Japan) as an external additive was mixed using HENSCHEL MIXER to obtain Toner (11). The Toner (11) was then mixed with a carrier which was obtained by coating ferrite particles having an average particle diameter of 80 μm with a silicone resin to obtain a Developer (11) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 12

| | |
|---|---|
| Polyester resin (weight average molecular weight: 182,000, THF insoluble content: 30% by weight, acid value: 55 mgKOH/mg) | 83 parts |
| Carbon black (trade name: #44, manufactured by Mitsubishi Chemical Corp.) | 10 parts |
| Charge controlling agent (organozirconium compound) | 2 parts |
| Carnauba wax | 5 parts |

The above components were mixed using a two axis kneader at 130° C. The kneaded mixture was cooled, pulverized and classified. The thus obtained mother toner had a weight average particle diameter of 10.5 μm. To the mother toner particles, 1.5 part of hydrophobic silica (R972 manufactured by Clariant Japan) as an external additive was mixed using HENSCHEL MIXER to obtain Toner (12). The Toner (12) was then mixed with a carrier which was obtained by coating ferrite particles having an average particle diameter of 80 μm with a silicone resin to obtain a Developer (12) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

EXAMPLE 13

| | |
|---|---|
| Polyester resin (weight average molecular weight: 182,000, THF insoluble content: 20% by weight) | 63 parts |
| Styrene-butyl acrylate copolymer (weight average molecular weight: 71,000, THF insoluble content: 25% by weight) | 20 parts |
| Carbon black (trade name: #44, manufactured by Mitsubishi Chemical Corp.) | 10 parts |
| Charge controlling agent (trade name: Spiron Black TR-H, manufactured by Hodogaya Chemical Corp.) | 2 parts |
| Carnauba wax | 5 parts |

The above components were mixed using a two axis kneader at 120° C. The kneaded mixture was cooled, pulverized and classified. The thus obtained mother toner had a weight average particle diameter of 10.5 μm. To the mother toner particles, 1.5 part of hydrophobic silica (R972 manufactured by Clariant Japan) as an external additive was mixed using HENSCHEL MIXER to obtain Toner (13). The Toner (13) was then mixed with a carrier which was obtained by coating ferrite particles having an average particle diameter of 80 μm with a silicone resin to obtain a Developer (13) having a toner content of 4% by weight. The thus obtained toner was measured for the melt viscosity $\eta_{100}$, melt viscosity $\eta_{120}$, the volume change Vt, the area change St, the fixation efficiency and the granularity in the same manner as that described in Example 1. The results are shown in Table 1.

TABLE 1

| Toner | Vt (%) | St (%) | $\eta_{100}/\eta_{120}$ | $\eta_{100}$ (Pa · s) | $\eta_{120}$ (Pa · s) | Fixation Efficiency (° C.) | Granularlity |
|---|---|---|---|---|---|---|---|
| (1) | 28 | 17 | 12 | $3.5 \times 10^4$ | $2.9 \times 10^3$ | 145 | 0.66 |
| C1 | 37 | 26 | 5 | $5.0 \times 10^4$ | $1.3 \times 10^4$ | 155 | 1.35 |
| C2 | 37 | 31 | 4 | $2.2 \times 10^5$ | $5.5 \times 10^4$ | 160 | 1.45 |
| C3 | 40 | 26 | 11 | $9.1 \times 10^4$ | $8.3 \times 10^3$ | 150 | 1.62 |
| C4 | 32 | 22 | 12 | $1.5 \times 10^4$ | $1.0 \times 10^4$ | 160 | 1.32 |
| C5 | 32 | 31 | 4 | $5.5 \times 10^5$ | $1.4 \times 10^5$ | 165 | 1.25 |
| C6 | 35 | 22 | 12 | $1.1 \times 10^5$ | $9.3 \times 10^3$ | 145 | 1.31 |
| (2) | 25 | 15 | 7 | $8.0 \times 10^4$ | $1.1 \times 10^4$ | 145 | 0.65 |
| (3) | 28 | 17 | 9 | $3.9 \times 10^5$ | $4.3 \times 10^4$ | 150 | 0.56 |
| (4) | 15 | 11 | 6 | $2.5 \times 10^5$ | $4.2 \times 10^4$ | 135 | 0.55 |
| (5) | 12 | 10 | 9 | $3.9 \times 10^5$ | $4.3 \times 10^4$ | 135 | 0.56 |
| (6) | 10 | 8 | 7 | $1.2 \times 10^5$ | $1.7 \times 10^4$ | 140 | 0.41 |
| (7) | 9 | 8 | 8 | $3.1 \times 10^5$ | $3.9 \times 10^4$ | 135 | 0.45 |
| (8) | 8 | 7 | 9 | $2.8 \times 10^5$ | $3.1 \times 10^4$ | 140 | 0.45 |
| (9) | 6 | 6 | 7 | $3.4 \times 10^5$ | $4.9 \times 10^4$ | 135 | 0.40 |
| (10) | 5 | 4 | 8 | $1.9 \times 10^5$ | $2.4 \times 10^4$ | 130 | 0.42 |
| (11) | 5 | 4 | 8 | $3.4 \times 10^5$ | $4.2 \times 10^4$ | 130 | 0.35 |
| (12) | 6 | 5 | 7 | $2.9 \times 10^5$ | $4.2 \times 10^4$ | 130 | 0.29 |
| (13) | 5 | 4 | 9 | $2.5 \times 10^5$ | $2.8 \times 10^4$ | 130 | 0.28 |

EXAMPLES 14–24 AND COMPARATIVE EXAMPLE 9

| | |
|---|---|
| Styrene-n-butyl acrylate copolymer | 85 parts |
| Carbon black (trade name: #44, manufactured by Mitsubishi Chemical Corp. | 10 parts |

-continued

| | |
|---|---|
| Charge controlling agent (trade name: Spiron Black TR-H, manufactured by Hodogaya Chemical Corp.) | 2 parts |
| Carnauba wax | 4 parts |

The above components were mixed using a two axis kneader. The kneaded mixture was cooled, pulverized and classified. To the mother toner particles, hydrophobic silica (R972 manufactured by Clariant Japan) as an external additive was mixed in an amount shown in Tables 2-1 through 2-3 using HENSCHEL MIXER to obtain a toner. The toner was then mixed with a carrier which was obtained by coating ferrite particles having an average particle diameter shown in Tables 2-1 through 2-3 with a silicone resin to obtain a developer having a toner content as shown in Tables 2-1 through 2-3. The toner was measured for the average sphericity, bulk density, weight average particle diameter Xw and number average particle diameter Xn. The results are summarized in Tables 2-1 through 2-3. Using the developer, the surface roughness Ra of the toner image prior to the fixation was measured according to the method shown below. Further, using the developer, the fixation efficiency and the granularity of the toner were measured in the same manner as that in Example 1 except that a heating roller fixation device (surface pressure: $0.7\times10^5$ Pa·s; rollers 11 and 12 having silicone resin offset preventing layers 14 and 17) as shown in FIG. 2 was substituted for the fixation device as shown in FIG. 3. The results are summarized in Tables 2-1 through 2-3.

Surface Roughness Ra:

A heating roller fixation device as shown in FIG. 2 is mounted on a commercially available copying machine (IMAGIO MF6550 manufactured by Ricoh Company, Ltd.) to which the sample developer is charged. Images of a standard printer test chart are formed with the copying machine operated at a developer charging amount and a bias voltage as shown in Tables 2-1 through 2-3. The developed image is transferred to a transfer paper either in a non-contact method using a charger or a contact method using a belt as shown in Tables 2-1 through 2-3. The transferred image before fixation is measured for the surface roughness Ra using a microscope (Color Laser 3D Profile Microscope VK-8500 manufactured by Keyence Corp.) in accordance with JIS B0601.

TABLE 2-1

| | Example | | | | |
|---|---|---|---|---|---|
| | 14 | 15 | 16 | 17 | 18 |
| Average diameter of carrier (μm) | 50 | 50 | 50 | 50 | 50 |
| Content of toner in developer (wt. %) | 4.5 | 4.0 | 3.0 | 5.0 | 5.5 |
| Charging amount of developer (μc/g) | −33 | −42 | −48 | −30 | −35 |
| Bias DC voltage | −500 | −520 | −600 | −630 | −550 |
| Surface roughness Ra (μm) | 2.0 | 1.3 | 1.2 | 1.7 | 1.8 |
| Average sphericity | 0.90 | 0.92 | 0.89 | 0.94 | 0.88 |

TABLE 2-1-continued

| | Example | | | | |
|---|---|---|---|---|---|
| | 14 | 15 | 16 | 17 | 18 |
| Bulk density (g/cm$^3$) | 0.28 | 0.26 | 0.32 | 0.35 | 0.25 |
| Amount of external additive (wt. %) | 0.5 | 0.8 | 2.2 | 1.2 | 0.4 |
| Xw/Xn | 1.5 | 1.4 | 1.6 | 1.6 | 1.3 |
| Xw (μm) | 10.5 | 10.5 | 11.0 | 10.5 | 10.5 |
| Transfer method | charger | charger | charger | charger | charger |
| Granularity | 0.60 | 0.55 | 0.48 | 0.44 | 0.46 |
| Fixation efficiency (° C.) | 145 | 145 | 140 | 135 | 140 |

TABLE 2-2

| | Example | | | | |
|---|---|---|---|---|---|
| | 19 | 20 | 21 | 22 | 23 |
| Average diameter of carrier (μm) | 50 | 80 | 80 | 50 | 50 |
| Content of toner in developer (wt. %) | 4.2 | 2.5 | 3.0 | 6.0 | 3.5 |
| Charging amount of developer (μc/g) | −45 | −30 | −34 | −28 | −50 |
| Bias DC voltage | −510 | −580 | −600 | −630 | −550 |
| Surface roughness Ra (μm) | 1.5 | 1.6 | 1.7 | 2.0 | 1.8 |
| Average sphericity | 0.90 | 0.94 | 0.93 | 0.95 | 0.97 |
| Bulk density (g/cm$^3$) | 0.24 | 0.38 | 0.40 | 0.32 | 0.35 |
| Amount of external additive (wt. %) | 0.6 | 1.0 | 3.0 | 2.5 | 2.0 |
| Xw/Xn | 1.2 | 1.2 | 1.3 | 1.2 | 1.3 |
| Xw (μm) | 9.5 | 10.5 | 9.5 | 7.5 | 5.8 |
| Transfer method | charger | charger | charger | charger | charger |
| Granularity | 0.42 | 0.38 | 0.35 | 0.33 | 0.29 |
| Fixation efficiency (° C.) | 140 | 135 | 135 | 140 | 145 |

TABLE 2-3

| | Example 24 | Comparative Example 9 |
|---|---|---|
| Average diameter of carrier (μm) | 80 | 80 |
| Content of toner in developer (wt. %) | 3.2 | 6.0 |
| Charging amount of developer (μc/g) | −31 | −39 |
| Bias DC voltage | −500 | −560 |
| Surface roughness Ra (μm) | 1.6 | 3.0 |
| Average sphericity | 0.98 | 0.93 |
| Bulk density (g/cm$^3$) | 0.42 | 0.35 |
| Amount of external additive (wt. %) | 1.2 | 3.0 |
| Xw/Xn | 1.1 | 1.4 |
| Xw (μm) | 4.0 | 7.5 |
| Transfer method | belt | belt |

TABLE 2-3-continued

| | Example 24 | Comparative Example 9 |
|---|---|---|
| Granularity | 0.25 | 0.99 |
| Fixation efficiency (° C.) | 145 | 150 |

EXAMPLES 25–35 AND COMPARATIVE EXAMPLES 10–12

| | |
|---|---|
| Styrene-n-butyl acrylate copolymer | 15 parts |
| Polyester resin | 70 parts |
| Carbon black (trade name: #44, manufactured by Mitsubishi Chemical Corp. | 10 parts |
| Charge controlling agent (trade name: Spiron Black TR-H, manufactured by Hodogaya Chemical Corp.) | 2 parts |
| Carnauba wax | 3 parts |

The above components were mixed using a two axis kneader. The kneaded mixture was cooled, pulverized and classified. To the mother toner particles, hydrophobic silica (R972 manufactured by Clariant Japan) as an external additive was mixed in an amount shown in Tables 3-1 through 3—3 using HENSCHEL MIXER to obtain a toner. The toner was then mixed with a carrier which was obtained by coating ferrite particles having an average particle diameter shown in Tables 3-1 through 3—3 with a silicone resin to obtain a developer having a toner content as shown in Tables 3-1 through 3—3. The toner was measured for the average sphericity, bulk density, weight average particle diameter Xw and number average particle diameter Xn. The results are summarized in Tables 3-1 through 3—3. Using the developer, the surface roughness Ra of the toner image prior to the fixation was measured according to the method shown below. Further, using the developer, the fixation efficiency and the granularity of the toner were measured in the same manner as that in Example 1 using the fixation device as shown in FIG. 3. The results are summarized in Tables 3-1 through 3—3.

Surface Roughness Ra:

A heating roller fixation device as shown in FIG. 3 is mounted on a commercially available copying machine (IMAGIO MF6550 manufactured by Ricoh Company, Ltd.) to which the sample developer is charged. Images of a standard printer test chart are formed with the copying machine operated at a developer charging amount and a bias voltage as shown in Tables 3-1 through 3—3. The developed image is transferred to a transfer paper either in a non-contact method using a charger or a contact method using a belt as shown in Tables 2-1 through 2-3. The transferred image before fixation is measured for the surface roughness Ra using a microscope (Color Laser 3D Profile Microscope VK-8500 manufactured by Keyence Corp.) in 10 accordance with JIS B0601.

TABLE 3-1

| | Example | | | | |
|---|---|---|---|---|---|
| | 25 | 26 | 27 | 28 | 29 |
| Average diameter of carrier (μm) | 50 | 50 | 50 | 80 | 80 |

TABLE 3-1-continued

| | Example | | | | |
|---|---|---|---|---|---|
| | 25 | 26 | 27 | 28 | 29 |
| Content of toner in developer (wt. %) | 4.5 | 5.5 | 6.0 | 2.5 | 3.0 |
| Charging amount of developer (μc/g) | −38 | −40 | −32 | −33 | −35 |
| Bias DC voltage | −620 | −550 | −530 | −560 | −550 |
| Surface roughness Ra (μm) | 2.5 | 2.0 | 1.9 | 1.7 | 2.4 |
| Average sphericity | 0.89 | 0.93 | 0.90 | 0.91 | 0.92 |
| Bulk density (g/cm$^3$) | 0.27 | 0.25 | 0.22 | 0.26 | 0.30 |
| Amount of external additive (wt. %) | 0.3 | 0.5 | 3.1 | 1.0 | 3.0 |
| Xw/Xn | 1.6 | 1.4 | 1.5 | 1.7 | 1.4 |
| Xw (μm) | 11.0 | 10.5 | 9.5 | 8.0 | 7.5 |
| Transfer method | charger | charger | charger | charger | charger |
| Granularity | 0.60 | 0.57 | 0.56 | 0.52 | 0.45 |
| Fixation efficiency (° C.) | 140 | 145 | 140 | 135 | 135 |

TABLE 3-2

| | Example | | | | |
|---|---|---|---|---|---|
| | 30 | 31 | 32 | 33 | 34 |
| Average diameter of carrier (μm) | 50 | 50 | 80 | 50 | 50 |
| Content of toner in developer (wt. %) | 4.0 | 5.8 | 3.5 | 4.0 | 4.5 |
| Charging amount of developer (μc/g) | −45 | −37 | −33 | −40 | −46 |
| Bias DC voltage | −550 | −630 | −600 | −580 | −550 |
| Surface roughness Ra (μm) | 1.8 | 1.6 | 1.8 | 2.5 | 1.7 |
| Average sphericity | 0.94 | 0.95 | 0.97 | 0.98 | 0.92 |
| Bulk density (g/cm$^3$) | 0.32 | 0.35 | 0.32 | 0.29 | 0.30 |
| Amount of external additive (wt. %) | 1.3 | 1.2 | 1.3 | 1.1 | 1.3 |
| Xw/Xn | 1.3 | 1.2 | 1.3 | 1.1 | 1.3 |
| Xw (μm) | 6.5 | 6.0 | 5.5 | 7.5 | 6.5 |
| Transfer method | charger | charger | belt | belt | belt |
| Granularity | 0.40 | 0.32 | 0.23 | 0.28 | 0.20 |
| Fixation efficiency (° C.) | 145 | 140 | 140 | 135 | 134 |

TABLE 3-3

| | Example | Comparative Example | | |
|---|---|---|---|---|
| | 35 | 10 | 11 | 12 |
| Average diameter of carrier (μm) | 80 | 80 | 80 | 80 |

TABLE 3-3-continued

| | Example | Comparative Example | | |
|---|---|---|---|---|
| | 35 | 10 | 11 | 12 |
| Content of toner in developer (wt. %) | 2.5 | 5.0 | 5.5 | 3.5 |
| Charging amount of developer (μc/g) | −34 | −25 | −39 | −35 |
| Bias DC voltage | −620 | −550 | −500 | −480 |
| Surface roughness Ra (μm) | 1.8 | 2.6 | 2.8 | 3.0 |
| Average sphericity | 0.92 | 0.93 | 0.96 | 0.90 |
| Bulk density ($g/cm^3$) | 0.27 | 0.33 | 0.35 | 0.30 |
| Amount of external additive (wt. %) | 1.0 | 2.6 | 3.7 | 3.1 |
| Xw/Xn | 1.4 | 1.2 | 1.1 | 1.3 |
| Xw (μm) | 8.2 | 6.3 | 4.5 | 5.9 |
| Transfer method | belt | belt | belt | charger |
| Granularity | 0.38 | 0.98 | 1.20 | 1.31 |
| Fixation efficiency (° C.) | 140 | 140 | 160 | 155 |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. An image forming method, comprising passing a toner image-bearing sheet through a nip defined between two rollers including a heater roller to fix the toner image on said sheet, wherein said toner image is formed from a toner comprising a binder resin, and a colorant, wherein the toner image before the passage through said nip has a toner volume V1 and a toner image area S1, wherein the toner image after the passage through said nip has a toner volume V2 and a toner image area S2, and wherein a volume change Vt and an area change St defined by the formulas shown below are 30% or less and 20% or less, respectively:

$$Vt(\%)=(V1-V2)/V1\times 100$$

$$St(\%)=(S2-S1)/S1\times 100$$

wherein V1, V2, S1 and S2 are as defined above.

2. An image forming method as claimed in claim 1, wherein said toner has a melt viscosity $\eta_{100}$ at 100° C. and a melt viscosity $\eta_{120}$ at 120° C. and wherein the ratio $\eta_{100}/\eta_{120}$ of the viscosity of the toner at 100° C. to the viscosity of the toner at 120° C. ranges from 6 to 10.

3. An image forming method as claimed in claim 2, wherein the melt viscosity $\eta_{100}$ at 100° C. is in the range of $1\times10^5$ to $4\times10^5$ Pa·s and the melt viscosity $\eta_{120}$ at 120° C. is in the range of $1\times10^4$ to $4\times10^5$ Pa·s.

4. An image forming method as claimed in claim 1, wherein said binder resin has a tetrahydrofuran-insoluble content of 10 to 80% by weight.

5. An image forming method as claimed in claim 1, wherein said binder resin comprises at least 50% by weight of a polyester resin having an acid value of 10 to 100 mgKOH/mg.

6. An image forming method as claimed in claim 5, wherein said binder resin additionally comprises no more than 50% by weight of another resin which is not compatible with said polyester resin.

7. An image forming method as claimed in claim 1, wherein said toner further comprises fine particles of a magnetic material.

8. An image forming method as claimed in claim 1, wherein said toner further comprises inorganic powder incorporated therein.

9. An image forming method as claimed in claim 1, wherein said toner further comprises an organic zirconium compound as a charge controlling agent.

10. An image forming method as claimed in claim 1, wherein said toner further comprises 0.01 to 5% by weight of inorganic powder as an external additive.

11. An image forming method as claimed in claim 1, wherein said toner has a weight average particle diameter of 4 to 10 μm.

12. An image forming method as claimed in claim 1, wherein the toner image before the passage through said nip has a surface roughness of 2.5 μm or less.

13. An image forming method as claimed in claim 12, wherein at least one of the two rollers is elastic.

14. An image forming method as claimed in claim 12, wherein each of the two rollers has a rigid surface and wherein the toner image before the passage through said nip has a surface roughness of 2.0 μm or less.

15. An image forming method, comprising passing a toner image-bearing sheet through a nip defined between two rollers including a heater roller to fix the toner image on said sheet, wherein said toner image is formed from a toner comprising a binder resin, and a colorant, wherein the toner image before the passage through said nip has a surface roughness of 2.5 μm or less, and wherein the toner has a bulk density of at least 0.30 $g/cm^3$.

16. An image forming method as claimed in claim 15, wherein at least one of the two rollers is elastic.

17. An image forming method as claimed in claim 15, wherein each of the two rollers has a rigid surface and wherein the toner image before the passage through said nip has a surface roughness of 2.0 μm or less.

18. An image forming method as claimed in claim 15, wherein said toner has an average sphericity of at least 0.92.

19. An image forming method as claimed in claim 15, wherein said toner further comprises inorganic powder as an external additive.

20. An image forming method as claimed in claim 15, wherein said toner has a weight average particle diameter Xw and a number average particle diameter Xn, and wherein the ratio Xw/Xn is 1.3 or less.

21. An image forming method as claimed in claim 15, wherein said toner has a weight average particle diameter of 4 to 10 μm.

22. An image forming method as claimed in claim 15, further comprising developing an electrostatic latent image on a photoconductor with said toner to form a toner image thereon, and contacting said toner image on said photoconductor with said sheet to transfer said toner image from said photoconductor to said sheet.

* * * * *